US007861786B2

(12) United States Patent
Hill, Jr. et al.

(10) Patent No.: US 7,861,786 B2
(45) Date of Patent: Jan. 4, 2011

(54) METHOD AND APPARATUS FOR FLUID BYPASS OF A WELL TOOL

(75) Inventors: Thomas G. Hill, Jr., The Woodlands, TX (US); Jeffrey L. Bolding, Kilgore, TX (US); David Randolph Smith, Kilgore, TX (US)

(73) Assignee: BJ Services Company, U.S.A., Houston, TX (US)

( * ) Notice: Subject to any disclaimer, the term of this patent is extended or adjusted under 35 U.S.C. 154(b) by 412 days.

(21) Appl. No.: 11/793,669

(22) PCT Filed: Dec. 22, 2005

(86) PCT No.: PCT/US2005/046622

§ 371 (c)(1),
(2), (4) Date: Mar. 14, 2008

(87) PCT Pub. No.: WO2006/069247

PCT Pub. Date: Jun. 29, 2006

(65) Prior Publication Data

US 2008/0169106 A1 Jul. 17, 2008

Related U.S. Application Data

(60) Provisional application No. 60/593,216, filed on Dec. 22, 2004.

(51) Int. Cl.
*E21B 43/16* (2006.01)

(52) U.S. Cl. ..... 166/305.1; 166/332.8

(58) Field of Classification Search ..... 166/305.1, 166/332.8, 183

See application file for complete search history.

(56) References Cited

U.S. PATENT DOCUMENTS

| | | | | |
|---|---|---|---|---|
| 5,117,913 | A | 6/1992 | Themig | 166/310 |
| 6,622,791 | B2 | 9/2003 | Kelley et al. | 166/313 |
| 2006/0021750 | A1 | 2/2006 | Lugimer et al. | 166/169 |
| 2008/0271893 | A1 * | 11/2008 | Hill et al. | 166/305.1 |
| 2008/0277119 | A1 * | 11/2008 | Hill et al. | 166/305.1 |
| 2008/0308268 | A1 * | 12/2008 | Hill et al. | 166/129 |

OTHER PUBLICATIONS

PCT International Search Report and Written Opinion corresponding to PCT/US2005/046622, dated Aug. 8, 2006.

* cited by examiner

*Primary Examiner*—William P Neuder
(74) *Attorney, Agent, or Firm*—Zarian Midgley & Johnson PLLC

(57) ABSTRACT

Apparatuses and methods to inject chemical stimulants (284) to a production zone (102, 202) through a string of production tubing (110, 210) around a downhole obstruction are disclosed. The apparatuses and methods include deploying an anchor seal assembly (200) to a landing profile (120, 220) located within a string of production tubing (110, 210). The anchor seal assembly (200) is in communication with a surface station through an injection conduit (260, 264) and includes a bypass pathway (262) to inject various fluids to a zone below.

31 Claims, 3 Drawing Sheets

METHOD AND APPARATUS FOR FLUID BYPASS OF A WELL TOOL

CROSS-REFERENCE TO RELATED APPLICATION

This application claims the benefit of provisional application U.S. Ser. No. 60/593,216 filed Dec. 22, 2004.

BACKGROUND OF THE INVENTION

The present invention generally relates to subsurface apparatuses used in the petroleum production industry. More particularly, the present invention relates to an apparatus and method to conduct fluid through subsurface apparatuses, such as a subsurface safety valve, to a downhole location. More particularly still, the present invention relates to apparatuses and methods to install a subsurface safety valve incorporating a bypass conduit allowing communications between a surface station and a lower zone regardless of the operation of the safety valve.

Various obstructions exist within strings of production tubing in subterranean wellbores. Valves, whipstocks, packers, plugs, sliding side doors, flow control devices, expansion joints, on/off attachments, landing nipples, dual completion components, and other tubing retrievable completion equipment can obstruct the deployment of capillary tubing strings to subterranean production zones. One or more of these types of obstructions or tools are shown in the following United States Patents which are incorporated herein by reference: Young, U.S. Pat. No. 3,814,181; Pringle, U.S. Pat. No. 4,520,870; Carmody et al., U.S. Pat. No. 4,415,036; Pringle, U.S. Pat. No. 4,460,046; Mott, U.S. Pat. No. 3,763,933; Morris, U.S. Pat. No. 4,605,070; and Jackson et al., U.S. Pat. No. 4,144,937. Particularly, in circumstances where stimulation operations are to be performed on non-producing hydrocarbon wells, the obstructions stand in the way of operations that are capable of obtaining continued production out of a well long considered "depleted." Most depleted wells are not lacking in hydrocarbon reserves, rather the natural pressure of the hydrocarbon producing zone is so low that it fails to overcome the hydrostatic pressure or head of the production column. Often, secondary recovery and artificial lift operations will be performed to retrieve the remaining resources, but such operations are often too complex and costly to be performed on all wells. Fortunately, many new systems enable continued hydrocarbon production without costly secondary recovery and artificial lift mechanisms. Many of these systems utilize the periodic injection of various chemical substances into the production zone to stimulate the production zone thereby increasing the production of marketable quantities of oil and gas. However, obstructions in the producing wells often stand in the way to deploying an injection conduit to the production zone so that the stimulation chemicals can be injected. While many of these obstructions are removable, they are typically components required to maintain production of the well so permanent removal is not feasible. Therefore, a mechanism to work around them would be highly desirable.

The most common of these obstructions found in production tubing strings are subsurface safety valves. Subsurface safety valves are typically installed in strings of tubing deployed to subterranean wellbores to prevent the escape of fluids from one zone to another. Frequently, subsurface safety valves are installed to prevent production fluids from "blowing out" from a lower production zone either to an upper zone or to the surface. Absent safety valves, sudden increases in downhole pressure can lead to disastrous blowouts of fluids into the atmosphere or isolated zones. Therefore, numerous drilling and production regulations throughout the world require safety valves installed within strings of production tubing before certain operations are allowed to proceed.

Safety valves allow communication between the isolated zones under regular conditions but are designed to shut when undesirable downhole conditions exist. One popular type of safety valve is commonly referred to as a surface controlled subsurface safety valve (SCSSV). SCSSVs typically include a closure member generally in the form of a circular or curved disc, a rotatable ball, or a poppet arrangement, that engages a corresponding valve seat to isolate zones located above and below the closure member in the subsurface well. The SCSSV is preferably constructed such that the flow through the valve seat is as unrestricted as possible. Usually, SCSSVs are located within the production tubing and isolate production zones from upper portions of the production tubing. Optimally, SCSSVs function as high-clearance check valves, in that they allow substantially unrestricted flow therethrough when opened and completely seal off flow in one direction when closed. Particularly, production tubing safety valves prevent fluids from production zones from flowing up the production tubing when closed but still allow for the flow of fluids (and movement of tools) into the production zone from above.

Closure members in SCSSVs are often energized with a biasing member (spring, hydraulic cylinder, gas charge and the like, as well known in the industry) such that if no pressure is exerted from the surface, the valve remains closed. In this closed position, any build-up of pressure from the production zone below will thrust the closure member against the valve seat and act to strengthen any seal therebetween. During use, closure members are opened to allow the free flow and travel of production fluids and tools therethrough.

Formerly, to install a chemical injection conduit around a production tubing obstruction, the entire string of production tubing had to be retrieved from the well and the injection conduit incorporated into the string prior to replacement. This process is expensive and time consuming, so it can only be performed on wells having enough production capability to justify the expense. A simpler and less costly solution would be well received within the petroleum production industry.

SUMMARY OF THE INVENTION

The deficiencies of the prior art are addressed by an anchor seal assembly to be deployed inside a string of production tubing. The subsurface safety valve assembly preferably includes a main body providing an upper connection to an upper injection conduit, an engagement profile, a closure member valve, and a lower connection to a lower injection conduit. The safety valve preferably includes a pathway extending through the main body and around the valve to connect the upper connection to the lower connection. The engagement profile is preferably configured to be retained within a landing profile located within the string of production tubing. The safety valve also preferably includes an actuation conduit to operate the valve between an open position and a closed position and a seal assembly to seal an interface between the string of production tubing and the main body.

The deficiencies of the prior art are also addressed by a method to inject fluid into a well below a subsurface safety valve. The method includes installing a string of production tubing into the well, the string of production tubing including a hydraulic profile. The method includes deploying a subsurface safety valve to the string of production tubing upon a distal end of an upper injection conduit, the subsurface safety valve including a closure member. The method preferably includes engaging the subsurface safety valve into the landing profile. The method preferably includes extending a lower injection conduit from the subsurface safety valve to a lower zone, the lower injection conduit in communication with the upper injection conduit through a bypass pathway of the subsurface safety valve. The method preferably includes injecting a fluid from a surface location to the lower zone through the upper injection conduit, the bypass pathway, and the lower injection conduit.

The deficiencies of the prior art are also addressed by a method to inject fluid into a well. The method preferably includes installing a string of production tubing into the well, the production tubing including a landing profile. The method preferably includes deploying a subsurface safety valve to the landing profile, the subsurface safety valve connected to the distal end of an upper injection conduit. The method preferably includes installing a lower injection conduit to a distal end of the subsurface safety valve, the lower injection conduit in communication with the upper injection conduit through a bypass pathway. The method preferably includes injecting the fluid from a surface location through the subsurface safety valve to a location below the subsurface safety valve in the well.

The deficiencies of the prior art are further addressed by a method to inject a fluid into a well. The method preferably includes installing a string of production tubing into the well, wherein the production tubing including a landing profile. The method also preferably includes deploying an anchor seal assembly to the landing profile upon a distal end of an upper injection conduit. The method preferably includes installing a lower injection conduit to a distal end of the anchor seal assembly, wherein the lower injection conduit is in communication with the upper injection conduit through a bypass pathway. The method also preferably includes injecting the fluid from a surface location through the bypass pathway to a location below the anchor valve assembly in the well.

The deficiencies of the prior art are also addressed by an anchor seal assembly to be deployed inside a string of production tubing. The anchor seal assembly includes a main body providing an upper connection to an upper injection conduit, an engagement profile, and a lower connection to a lower injection conduit. The anchor seal assembly preferably includes a downhole production component housed within the main body wherein a pathway extending through the main body is diverted around the downhole production component to connect the upper and lower connections. Preferably, the engagement profile is configured to be retained within a landing profile located within the string of production tubing. The anchor seal assembly also preferably includes an actuation conduit to operate the downhole production component and a seal assembly to seal an interface between the string of production tubing and the main body. The anchor seal assembly can include a landing profile located within a component selected from the group consisting of a hydraulic nipple, a subsurface safety valve, and a well tool.

The deficiencies of the prior art are also addressed by a fluid bypass assembly to be engaged within a landing profile of a string of production tubing. The fluid bypass assembly preferably includes a main body providing an upper connection to an upper injection conduit, an engagement profile, and a lower connection to a lower injection conduit. The fluid bypass assembly preferably includes a downhole production component wherein a pathway extending through the main body is diverted around the downhole production component to connect the upper connection and the lower connection. The fluid bypass assembly can include a landing profile located within a component selected from the group consisting of a hydraulic nipple, a subsurface safety valve, and a well tool.

DETAILED DESCRIPTION OF THE PREFERRED EMBODIMENTS

Figure 1:
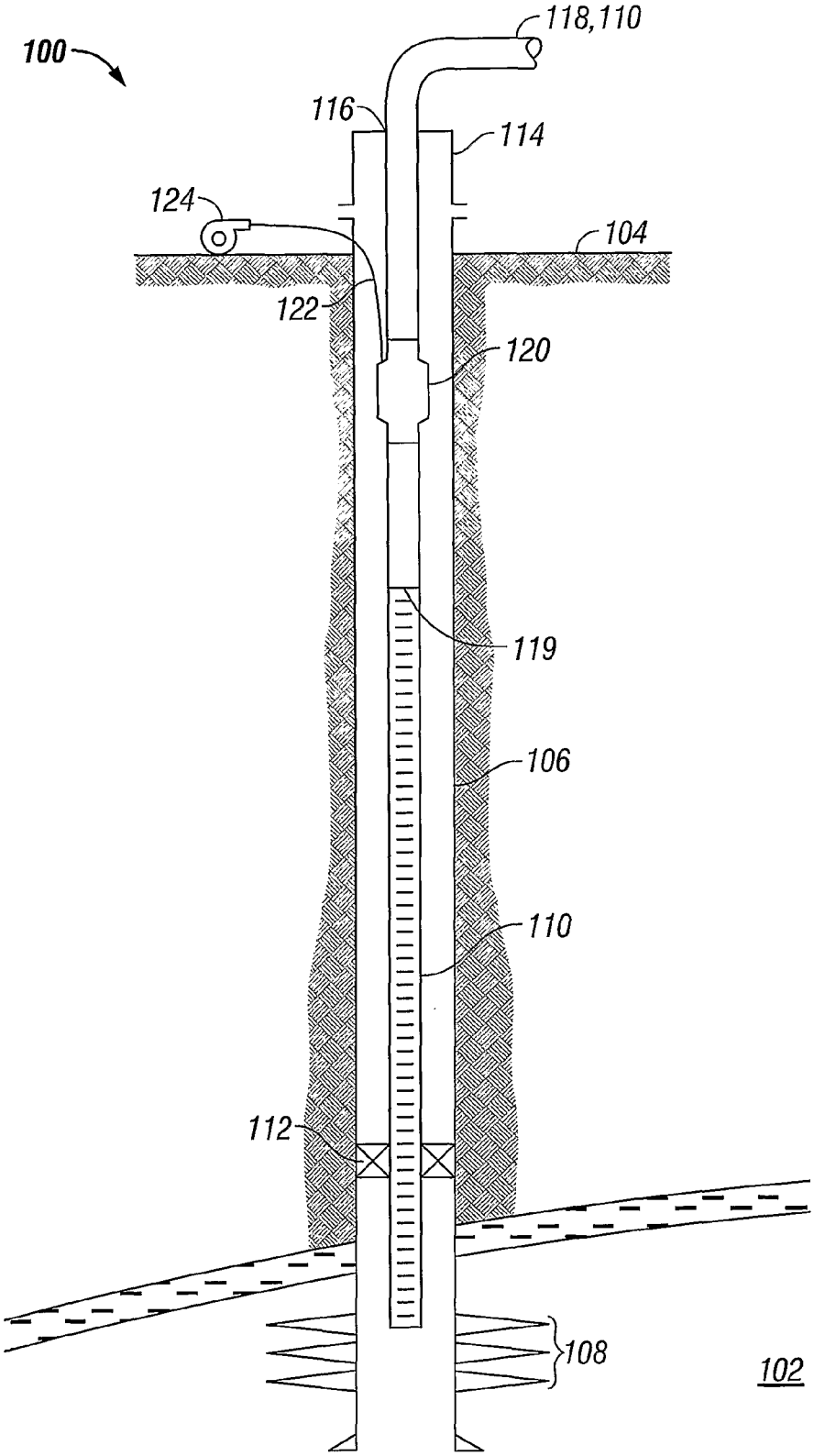
FIG. 1 is a schematic cross-sectional view drawing of a non-producing well to be revived using a production tubing bypass assembly of the present invention.

Referring initially to FIG. 1, a well production system 100 is shown schematically. Normally, well production system 100 allows for the recovery of production fluids (hydrocarbons) from an underground reservoir 102 to a location on the surface 104. To retrieve the production fluids, a cased borehole 106 is drilled from the surface 104 to reservoir 102. Perforations 108 allow the flow of production fluids from reservoir 102 into cased borehole 106 where reservoir pressure pushes them to the surface 102 through a string of production tubing 110. A packer 112 preferably seals the annulus between production tubing 110 and cased borehole 106 to prevent the pressurized production fluids from escaping through the annulus. A wellhead 114 caps the upper end of the cased wellbore 106 to prevent annular fluids from escaping into and polluting the environment. Preferably, wellhead 114 provides sealed ports 116 where strings of tubing (for example, production tubing 110) are allowed to pass through while still maintaining the hydraulic integrity of wellhead 114. Upper end 118 of production tubing 110 preferably protrudes from wellhead 114 and carries fluids produced from reservoir 102 to a pumping or containment station (not shown).

However, well production system 100 is shown in FIG. 1 as a non-producing system, where the pressures of fluids in reservoir 102 are no longer high enough to push the production fluids to the surface. Instead, the pressure, or "head" of reservoir 102 is only enough to raise a column of production fluids partially up production tubing 110, as indicated at 119. Ordinarily, in situations where secondary recovery or other artificial lift procedures are not possible or are cost prohibitive, for example, on offshore wells, well system 100 would be considered depleted. Depleted or non-producing wells are those where additional hydrocarbons remain downhole, but there is no cost-effective manner to retrieve those hydrocarbons. Fortunately, certain chemicals and stimulants can be injected into the production reservoir 102 to assist overcoming the hydrostatic head to retrieve the hydrocarbons. The stimulants must be periodically injected into the reservoir 102 to keep the fluids flowing. Unfortunately, various downhole obstructions in production tubing 110 can prevent capillary tubes injecting these chemicals and stimulants from reaching the downhole reservoir 102. These obstructions include, but are not limited to, subsurface safety valves, other downhole valves, flow control subs, sliding side doors, landing nipples, whipstocks, packers, completion unions, and various downhole measurement devices.

Referring still to FIG. 1, a section of production tubing 110 supporting landing profile 120 is shown located below wellhead 114 and in-line with production tubing 110. Landing profile 120 is preferably configured to receive an anchor seal assembly (200 of FIG. 2). Landing profile 120 may be in a hydraulic nipple, a subsurface safety valve, or a well tool. A hydraulic actuating line 122 optionally extends from landing profile 120 to the surface through the annulus formed between cased borehole 106 and production tubing 110. A hydraulic pump 124 provides working pressure to actuating line 122 that is used to operate a subsurface safety valve (or other production tubing apparatus) located within anchor seal assembly (200 of FIG. 2) that is engaged within landing profile 120. While hydraulic actuating line 122 and hydraulic pump 124 are shown in FIG. 1, it should be understood by one skilled in the art that any communications mechanism, including, but not limited to, electrical wire, fiber optic cable, or mechanical linkages, can be used to operate a subsurface safety valve retained within landing profile 120, or to traverse the landing profile such as shown in FIG. 3 to sample fluids, sense physical or chemical conditions or inject chemicals below the landing profile at the perforated production zone 108.

Furthermore, it should also be understood that landing profile 120 within production tubing 110 can exist by itself as a component of production tubing string 110 or can be constructed as a component of a pre-existing production tubing string component (not shown), such as a subsurface safety valve. Particularly, most subsurface safety valves are constructed having such a profile so a pre-existing subsurface safety valve can be a prime choice for a landing profile 120. As such, landing profile 120 can be an inner-bore profile feature located within a previously installed subsurface safety valve that has ceased to function. Under such an arrangement, an anchor seal assembly containing a replacement subsurface safety valve can be engaged within landing profile 120 of a non-functioning subsurface safety valve to restore valve functionality.

Because elevated pressures of production fluids in production tubing 110 at upper end 118 are hazardous to downstream components, most safety regulations require the installation of a subsurface safety valve (SSV) below wellhead 114. Subsurface safety valves act to shut off flow through production tubing 110 below wellhead 114 either automatically or at the direction of an operator at the surface. Automatic shut off can occur when the pressure or flow rate of production fluids from reservoir 102 through production tubing 110 exceed a predetermined design limit, or when hydraulic pressure on the hydraulic actuating line 122 is reduced or terminated. Selective shut off usually occurs when the well operator manually shuts a closure device by reducing or terminating the hydraulic pressure on control line 122 which permits the subsurface safety valve to close. The operator may decide to shut off flow from production tubing 110 either temporarily or indefinitely to perform maintenance operations, to halt production, to install new surface equipment, or for any other purpose. Regardless of the reason, shutting off production flow at a subsurface safety valve (not shown) below wellhead 114 offers an added layer of protection against blowouts than operators would obtain by merely shutting off the well with valves located above wellhead 114.

Figure 2:
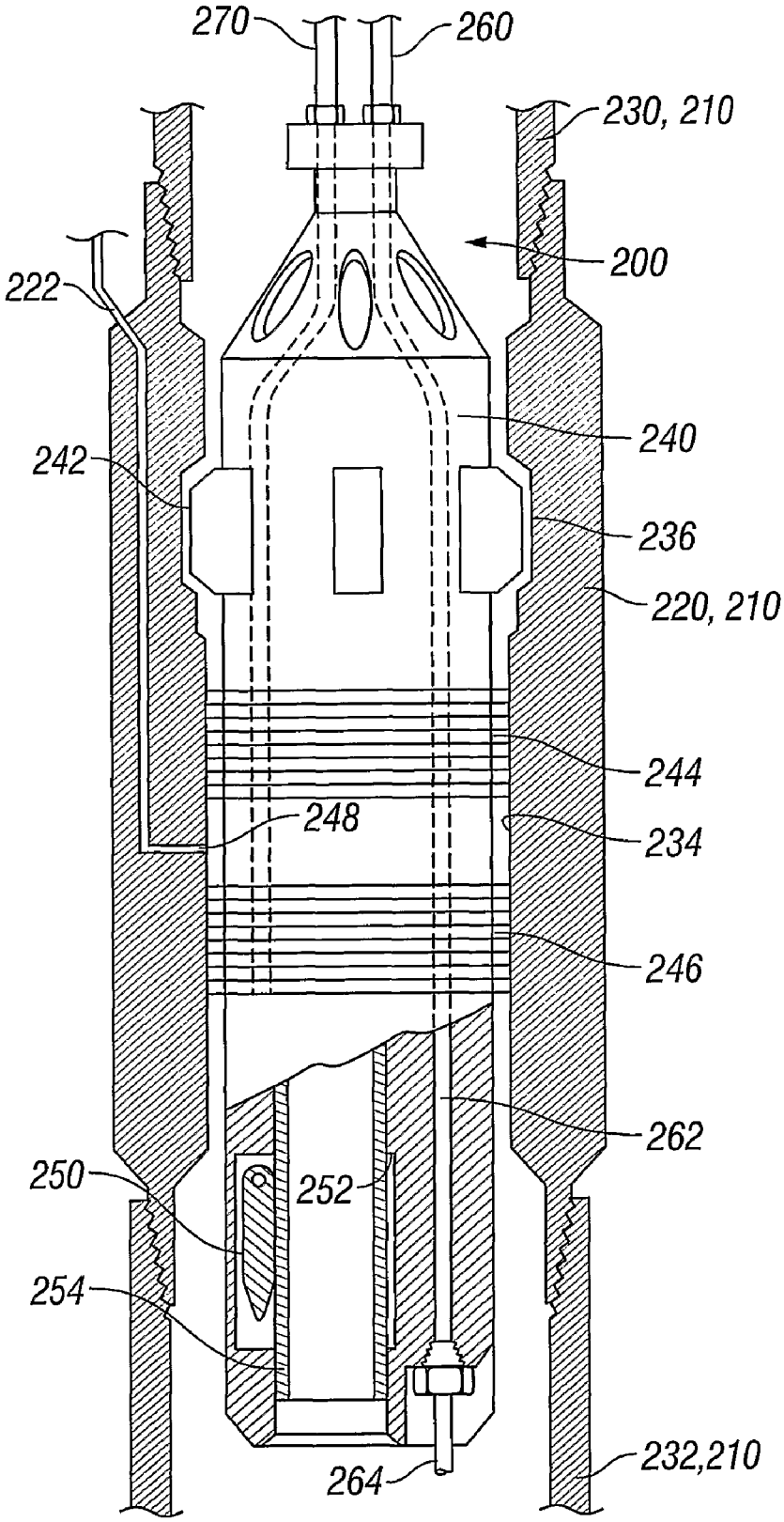
FIG. 2 is a schematic cross-sectional view drawing of a production tubing bypass assembly in accordance with an embodiment of the present invention.
Figure 3:
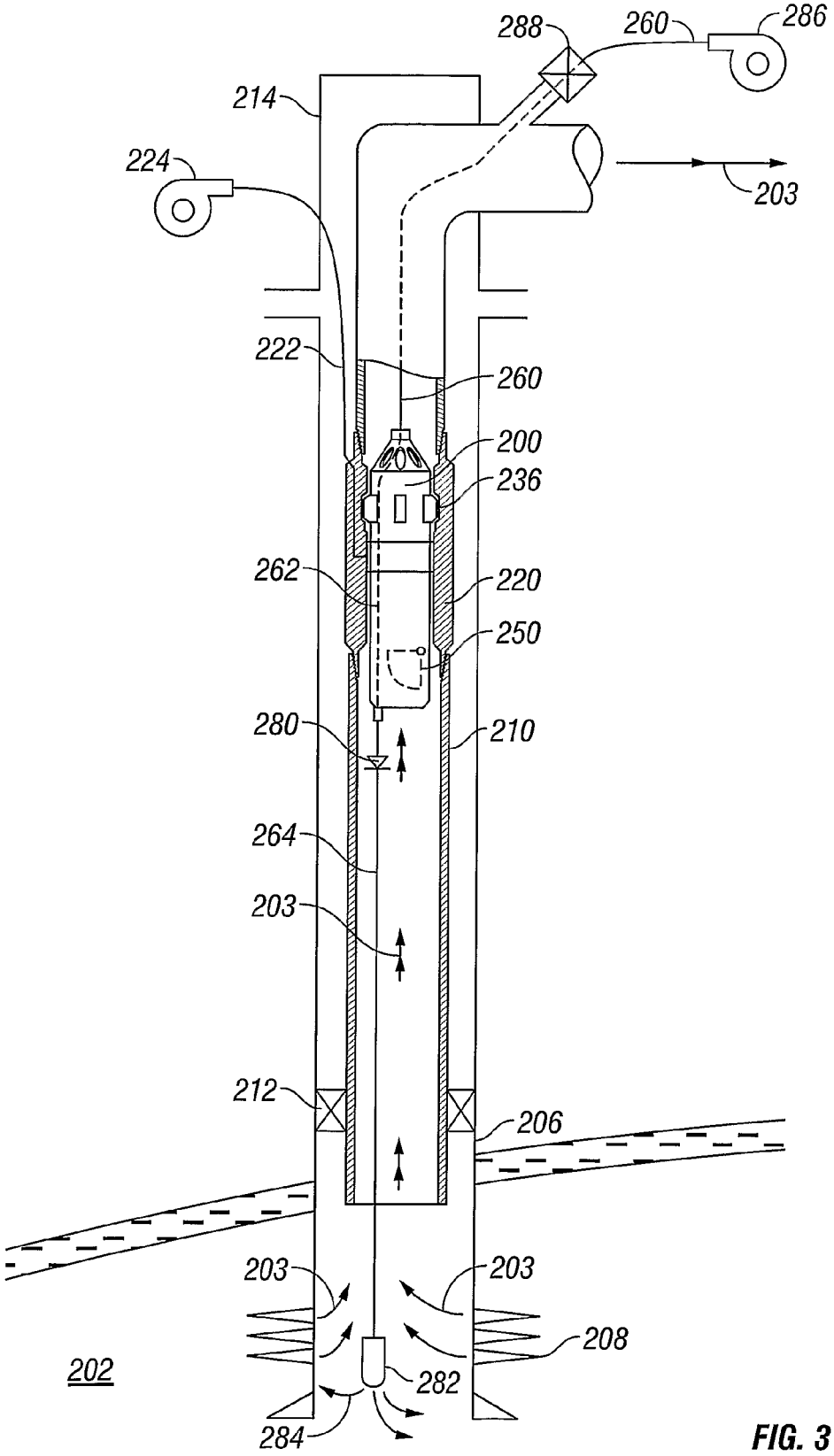
FIG. 3 is a schematic cross-sectional view drawing of a formerly non-producing well revived using production tubing bypass assembly of FIG. 2 in accordance with an embodiment of the present invention.

Referring now to FIG. 2, an anchor seal assembly 200 in accordance with an embodiment of the present invention is shown engaged within a landing profile 220 of a production string 210. Production string 210 includes joints of tubing 230, 232 above and below landing profile to form a continuous string of production tubing 210. Landing profile 220 is preferably constructed with a substantially constant primary bore 234 and a larger diameter profiled retaining bore 236. An optional hydraulic actuating line 222 communicates between primary bore 234 and a surface pumping station (not shown) through the annulus formed between production string 210 and the wellbore (206 of FIG. 3).

Anchor seal assembly 200 is shown constructed as a substantially tubular main body 240 having a locking dog outer profile 242 and a pair of hydraulic seal packers 244, 246. Locking dog profile 242 is configured to engage with and be retained by profiled retaining bore 236 of landing profile 220. While one system for locking anchor seal assembly 200 securely within landing profile 220 is shown schematically in FIG. 2, it should be understood by one of ordinary skill in the art that various other mechanisms for securing anchor seal assembly 200 within landing profile 220 are feasible. Packer seals 244 and 246 above and below a port 248 of actuating line 222 (if present) allow a device at the surface to communicate hydraulically with anchor seal assembly 200 through a corresponding port (not shown) on safety valve main body 240 located between packer seals 244, 246. Such communication can be used to lock anchor seal assembly 200 within landing profile 220, engage or disengage a subsurface safety valve, or perform any other task the anchor seal assembly would require.

Anchor seal assembly 200 of FIG. 2 is shown housing a subsurface safety valve that includes a flapper disc 250 to selectively engage and hydraulically seal with a valve seat 252. An operation mandrel 254 is preferably driven by hydraulic energy (for example, from actuating line 222) into contact with flapper disc 250 to retain it in an open position (shown). In the event fluid communication with the production zone below safety valve is to be halted, operating mandrel 254 is retrieved and flapper disc 250 closes against valve seat 252. Increases in pressure below anchor seal assembly 200 acts upon flapper disc 250 to urge it into tighter engagement with valve seat 252, thereby maintaining seal integrity. Finally, packer seals 244, 246 seal anchor seal assembly 200 against production tubing string 210 to prevent production fluids from undesirably bypassing flapper disc 250. While the anchor seal assembly 200 is capable of housing any type of production tubing component, it is expected that a flapper-disc 250 safety valve will be the most common component housed. The subsurface safety valve can also be formed with a ball valve or a poppet valve arrangement actuated to permit fluid communication through the landing profile 220 of the present invention without departing from the intent of the present disclosure. Because pre-existing subsurface safety valves deteriorate over time, malfunction, and typically include the requisite landing profile 220 with a profiled retaining bore 236, they are prime candidates for engagement with an anchor seal assembly 200 housing a replacement safety valve. Alternatively, an anchor seal assembly can contain a whipstock, packer, bore plug, or any other component, all in a manner well known to those skilled in this industry.

Anchor seal assembly 200 is preferably deployed to landing profile 220 within production tubing string 210 upon the distal end of an upper injection conduit 260. As stated above, landing profile 220 can be a standalone component or can be a feature of another production tubing string 210 component, for instance, a pre-existing subsurface safety valve (not shown). Preferably, injection conduit 260, 264 is a hydraulic capillary tube, but any communications conduit, including, but not limited to, wireline, slickline, fiber-optic, or coiled tubing can be used. Injection conduit 260, 264 of FIG. 2 is a hydraulic conduit and is capable of injecting fluids below subsurface anchor seal assembly 200. A bypass pathway 262 connects upper injection conduit 260 above main body 240 with a lower injection conduit 264 below main body 240. Bypass pathway 262 enables an operator at the surface to hydraulically communicate with the production zone below anchor seal assembly 200 regardless of whether flapper disc 250 is the open or closed position. Preferably, check valves (not shown) in injection conduits 260, 264 prevent fluids from flowing from production zone to the surface. Alternatively, two-way communication can be provided through the conduits by removing the check valve as desired for particular applications. Formerly, injection conduits were engaged through the bore of operating mandrel 254 and the opening of valve seat 252 to deliver fluids to a zone below a safety valve. Under those former systems, the injection conduit could restrict the flow through the safety valve and was required to be retrieved before the safety valve could be closed. U.S. patent application Ser. No. 10/708,338, entitled "Method and Apparatus to Complete a Well Having Tubing Inserted Through a Valve," filed Feb. 25, 2004 by David R. Smith, et al., hereby incorporated by reference herein, describes such a system.

Furthermore, FIG. 2 also depicts an alternative to actuating line 222 in the form of hydraulic actuation conduit 270 extending from the upper end of main body 240. In the event an actuating line 222 in annulus between production tubing string 210 and wellbore is damaged (or was never installed with original production tubing string 210), a secondary length of communications conduit 270 can extend from the surface to the main body 240 to operate operation mandrel 254 and flapper disc 250. If secondary length of conduit 270 is employed, actuating line 222 and port 248 are no longer necessary. Furthermore, dual packer seals 244, 246 can likewise be replaced with a single packer seal. Additionally, if secondary conduit 270 is used, it can be bundled with injection conduit 260 to reduce any flow interference or restrictions that might result from having two conduits 260 and 270 in the flow bore of production tubing string 210.

Referring now to FIG. 3, anchor seal assembly 200 containing a subsurface safety valve flapper disc 250 is shown installed in a cased wellbore 206. Production tubing string 210 including landing profile 220 is run into cased wellbore and perforations 208 allow well fluids 202 to enter cased wellbore 206 from the formation. A packer 212 isolates the annulus between production tubing 210 and the cased wellbore 206 so that production fluids 203 must flow to the surface through the bore of production tubing 210. Anchor seal assembly 200 is engaged within landing profile 220 and allows an upper injection conduit 260 to bypass the flapper valve 250 and communicate with the production zone via a lower injection conduit 264. A check valve 280 is optionally positioned below (shown) or above anchor seal assembly 200 to prevent the backflow of production fluids 203 up through injection conduits 264 and 260. A flow control valve 282 allows for the release of injected fluids 284 into the production zone.

Injected fluids 284 can be any liquid, foam, or gaseous formula that is desirable to inject into a production zone. Surfactants, acids, corrosion inhibitors, scale inhibitors, hydrate inhibitors, paraffin inhibitors, and miscellar solutions can be used as injected fluids 284. Injected fluids 284 are typically injected at the surface by injection pump 286 through upper injection conduit 260 entering production tubing string 210 through a Y-union 288. Once in place, production fluids 203 can enter production tubing string 210 at perforations 208, flow past flapper disc 250 of anchor seal assembly 200, and flow to surface through a sealed opening in wellhead 214. When it is desired to shut down the well, flapper disc 250 is closed preventing flow of well fluids from progressing to the surface. With flapper disc 250 closed, the injection of injected fluids 284 is still feasible through injection conduits 260 and 264. These injected fluids 284 enable a surface operator to perform work to stimulate or otherwise work over the production formation 202 while anchor seal assembly 200 is closed.

Landing profile 220 of FIG. 3 is shown communicating with the surface through actuating line 222 located in the annulus formed between cased wellbore 206 and production tubing string 210. As mentioned above in reference to FIG. 2, if actuating line 222 is non-functioning or is otherwise not available, a secondary communications conduit (270 of FIG. 2) may be deployed down the bore of production tubing string 210 alongside upper injection conduit 260. Such an arrangement could require the addition of a second Y-union to remove the secondary communications conduit 270 from the bore of tubing string 210.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed is:

1. A method to inject fluid into a well below a subsurface safety valve comprising:

deploying a subsurface safety valve to a string of production tubing, the string of production tubing including a landing profile, the subsurface safety valve including a flapper disc, an upper injection conduit and a lower injection conduit extending from the subsurface safety valve to a lower zone, said lower injection conduit in communication with the upper injection conduit through a bypass pathway of the subsurface safety valve;

engaging the subsurface safety valve into the landing profile;

extending an actuation conduit to the subsurface safety valve through a bore of the string of production tubing;

actuating the flapper disc between an open position and a closed position through the actuation conduit; and injecting a fluid from a surface location to the lower zone through the upper injection conduit, the bypass pathway, and the lower injection conduit.

2. The method of claim 1 further comprising installing a check valve in the lower injection conduit to prevent fluids from flowing from the lower zone to the surface location.

3. The method of claim 1 wherein the fluid injected from the surface location to the lower zone is selected from the group consisting of surfactants, acids, corrosion inhibitors, scam inhibitors, hydrate inhibitors, paraffin inhibitors, and miscellar solutions.

4. The method of claim 1 wherein the lower zone is a production zone.

5. The method of claim 1 further comprising communicating bi-directionally through the upper injection conduit, the bypass pathway, and the lower injection conduit between the lower zone and the surface location.

6. The method of claim 1 further comprising communicating unidirectionally through the upper injection conduit, the bypass pathway, and the lower injection conduit from the surface location to the lower zone.

7. The method of claim 1 wherein the subsurface safety valve is deployed upon a distal end of the upper injection conduit.

8. A method to inject a fluid into a well comprising:

deploying a subsurface safety valve to a landing profile disposed in a string of production tubing installed in the well;

extending an actuating conduit to the subsurface safety valve through a bore of the string of production tubing;

operating a flapper disc of the subsurface safety valve with the actuating conduit;

installing a lower injection conduit to a distal end of the subsurface safety valve, the lower injection conduit in communication with an upper injection conduit through a bypass pathway; and injecting the fluid from a surface location through the bypass pathway to a location below the subsurface safety valve in the well.

9. The method of claim 8 wherein the subsurface safety valve is deployed upon a distal end of the upper injection conduit.

10. A method to inject a fluid into a well comprising:

deploying an anchor seal assembly to a landing profile disposed in a string of production tubing installed in the well, said anchor seal assembly including an upper injection conduit and a lower injection conduit, the lower injection conduit connected to a distal end of the anchor seal assembly;

extending an actuating conduit to the anchor seal assembly through a bore of the string of production tubing;

operating a closure member valve of the anchor seal assembly with the actuating conduit; and injecting the fluid from a surface location through a bypass pathway to a location below the anchor seal assembly in the well, said bypass pathway in communication with the upper injection conduit and the lower injection conduit.

11. The method of claim 10 wherein the anchor seal assembly is deployed upon a distal end of the upper injection conduit.

12. The method of claim 10 further comprising installing a check valve in the lower injection conduit to prevent fluids from flowing from the lower zone to the surface location.

13. The method of claim 10 wherein the fluid injected from the surface location to the lower zone is selected from the group consisting of surfactants, acids, corrosion inhibitors, scam inhibitors, hydrate inhibitors, paraffin inhibitors, and miscellar solutions.

14. The method of claim 10 wherein the lower zone is a production zone.

15. The method of claim 10 further comprising communicating bi-directionally through the upper injection conduit, the bypass pathway, and the lower injection conduit between the lower zone and the surface location.

16. The method of claim 10 further comprising communicating unidirectionally through the upper injection conduit, the bypass pathway, and the lower injection conduit from the surface location to the lower zone.

17. A method to inject fluid into a well below a subsurface safety valve comprising:

deploying a subsurface safety valve to a string of production tubing, the string of production tubing including a landing profile, the subsurface safety valve including an upper injection conduit and a lower injection conduit extending from the subsurface safety valve to a lower zone, said lower injection conduit in communication with the upper injection conduit through a bypass pathway of the subsurface safety valve;

engaging the subsurface safety valve into the landing profile;

injecting a fluid from a surface location to the lower zone through the upper injection conduit, the bypass pathway, and the lower injection conduit; and communicating bi-directionally through the upper injection conduit, the bypass pathway, and the lower injection conduit between the lower zone and the surface location.

18. The method of claim 17 wherein the subsurface safety valve includes a flapper disc.

19. The method of claim 18 further comprising extending the actuation conduit to the subsurface safety valve through an annulus formed between the string of production tubing and a cased wellbore.

20. The method of claim 18 further comprising actuating the flapper disc between an open position and a closed position through an actuation conduit.

21. The method of claim 20 further comprising extending the actuation conduit to the subsurface safety valve through a bore of the string of production tubing.

22. The method of claim 17 further comprising installing a check valve in the lower injection conduit to prevent fluids from flowing from the lower zone to the surface location.

23. The method of claim 17 wherein the fluid injected from the surface location to the lower zone is selected from the group consisting of surfactants, acids, corrosion inhibitors, scam inhibitors, hydrate inhibitors, paraffin inhibitors, and miscellar solutions.

24. The method of claim 17 wherein the lower zone is a production zone.

25. The method of claim 17 further comprising communicating unidirectionally through the upper injection conduit, the bypass pathway, and the lower injection conduit from the surface location to the lower zone.

26. A method to inject a fluid into a well comprising:

deploying a subsurface safety valve to a landing profile disposed in a string of production tubing installed in the well;

installing a lower injection conduit to a distal end of the subsurface safety valve, the lower injection conduit in communication with an upper injection conduit through a bypass pathway;

injecting the fluid from a surface location through the bypass pathway to a location below the subsurface safety valve in the well; and communicating bi-directionally through the upper injection conduit, the bypass pathway, and the lower injection conduit between the lower zone and the surface location.

27. The method of claim 26 further comprising operating a flapper disc of the subsurface safety valve with an actuating conduit.

28. The method of claim 27 further comprising extending the actuating conduit to the subsurface safety valve through a bore of the string of production tubing.

29. The method of claim 27 further comprising extending the actuating conduit to the subsurface safety valve through an annulus formed between the string of production tubing and a cased wellbore.

30. A method to inject a fluid into a well comprising:

deploying an anchor seal assembly upon a distal end of an upper injection conduit to a landing profile disposed in a string of production tubing installed in the well, said anchor seal assembly including a lower injection conduit, the lower injection conduit connected to a distal end of the anchor seal assembly;

injecting the fluid from a surface location through a bypass pathway to a location below the anchor seal assembly in the well, said bypass pathway in communication with the upper injection conduit and the lower injection conduit;

extending an actuating conduit to the anchor seal assembly through a bore of the string of production tubing; and operating a closure member valve of the anchor seal assembly with the actuating conduit.

31. A method to inject a fluid into a well comprising:

deploying an anchor seal assembly upon a distal end of an upper injection conduit to a landing profile disposed in a string of production tubing installed in the well, said anchor seal assembly including a lower injection conduit, the lower injection conduit connected to a distal end of the anchor seal assembly;

injecting the fluid from a surface location through a bypass pathway to a location below the anchor seal assembly in the well, said bypass pathway in communication with the upper injection conduit and the lower injection conduit;

extending an actuating conduit to the anchor seal assembly through an annulus formed between the string of production tubing and a cased wellbore; and operating a closure member valve of the anchor seal assembly with the actuating conduit.

* * * * *